US005342230A

United States Patent [19]

Louis

[11] Patent Number: 5,342,230

[45] Date of Patent: Aug. 30, 1994

[54] WATER SURVIVAL DEVICE

[75] Inventor: Olivier Louis, Marseille, France

[73] Assignee: Unitor A/S, Kolbotn, Norway

[21] Appl. No.: 983,551

[22] PCT Filed: Aug. 9, 1991

[86] PCT No.: PCT/FR91/00660

§ 371 Date: Feb. 2, 1993

§ 102(e) Date: Feb. 2, 1993

[87] PCT Pub. No.: WO92/03333

PCT Pub. Date: Mar. 5, 1992

[30] Foreign Application Priority Data

Aug. 24, 1990 [FR] France ..... 90 10796

[51] Int. Cl.[5] ..... B63B 35/58

[52] U.S. Cl. ..... 441/42; 114/366; 114/368

[58] Field of Search ..... 441/40–42; 114/365, 366, 368, 374, 345

[56] References Cited

U.S. PATENT DOCUMENTS 2,510,843 6/1950 Townshend ..... 441/42 X 2,851,078 9/1958 Mellon et al. ..... 441/41

2,959,278 11/1960 Mitchell et al. ..... 441/42

4,031,583 6/1977 Phillips ..... 9/14

FOREIGN PATENT DOCUMENTS 563098 6/1958 Belgium .

119333 9/1984 European Pat. Off. .

1122399 1/1962 Fed. Rep. of Germany ..... 441/42

1217673 5/1960 France .

*Primary Examiner*—Sherman Basinger

*Attorney, Agent, or Firm*—Ladas & Parry

[57] ABSTRACT

A water survival device has an inflatable liferaft and a pressurized gas bottle packed in a container. The container has a first waterproof compartment containing the liferaft and a second waterproof compartment containing the pressurized gas bottle. The first and second waterproof compartments are separated by a substantially planar rigid watertight partition. The second waterproof compartment can be opened without opening the first waterproof compartment so that it is possible to inspect the pressurized gas bottle without opening the first waterproof compartment.

16 Claims, 6 Drawing Sheets

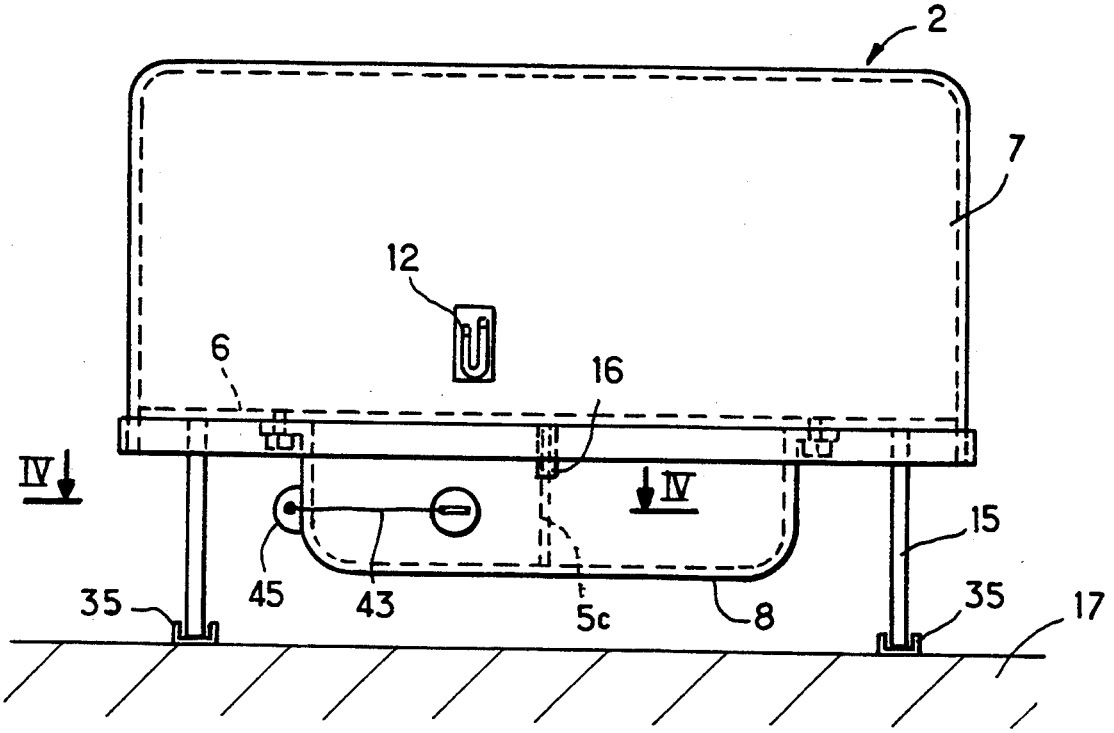
FIG. 3
FIG. 4
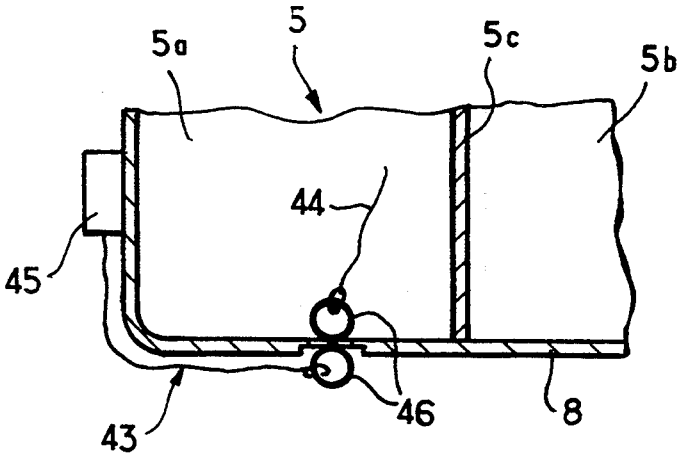

FIG. 5
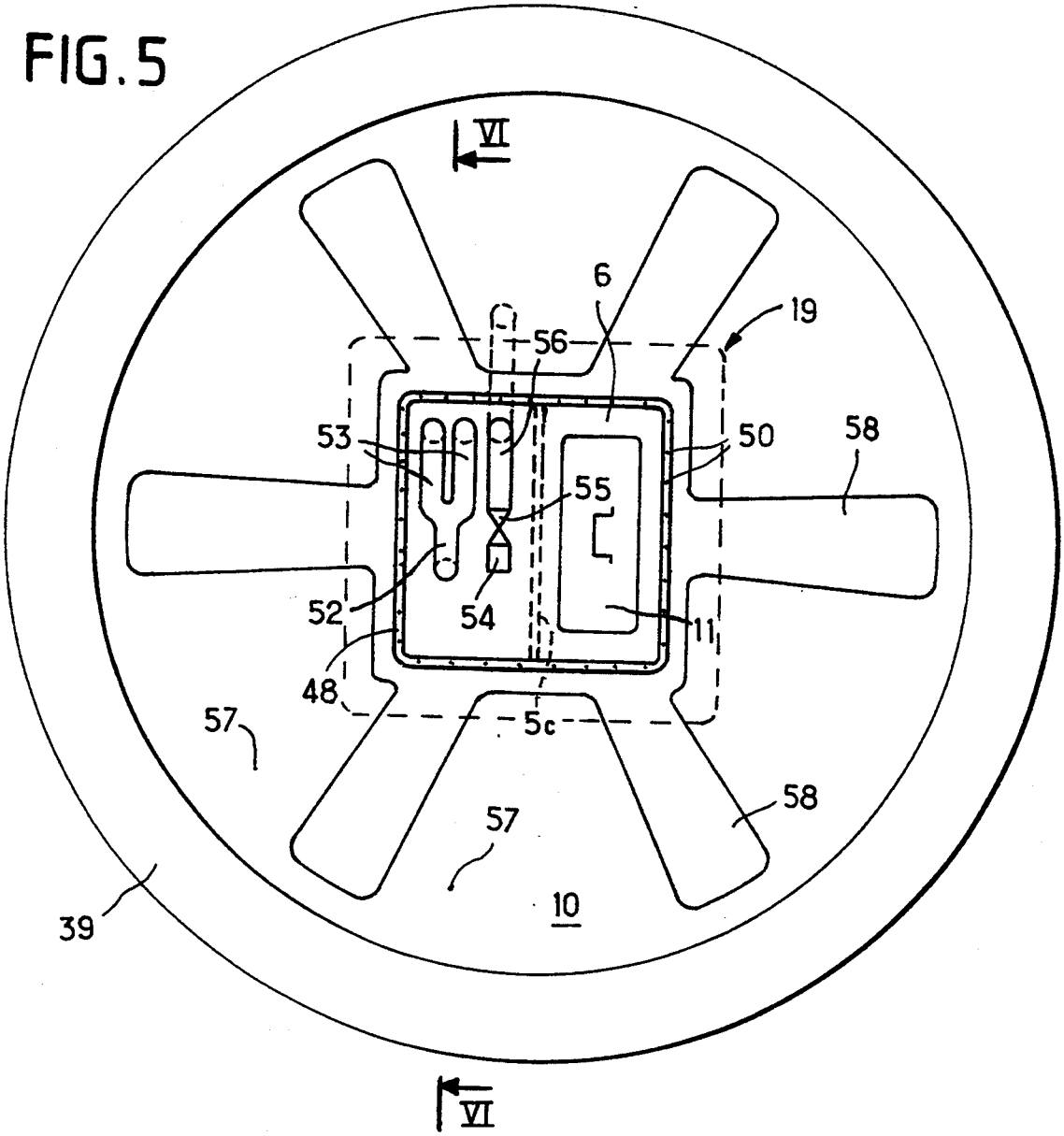
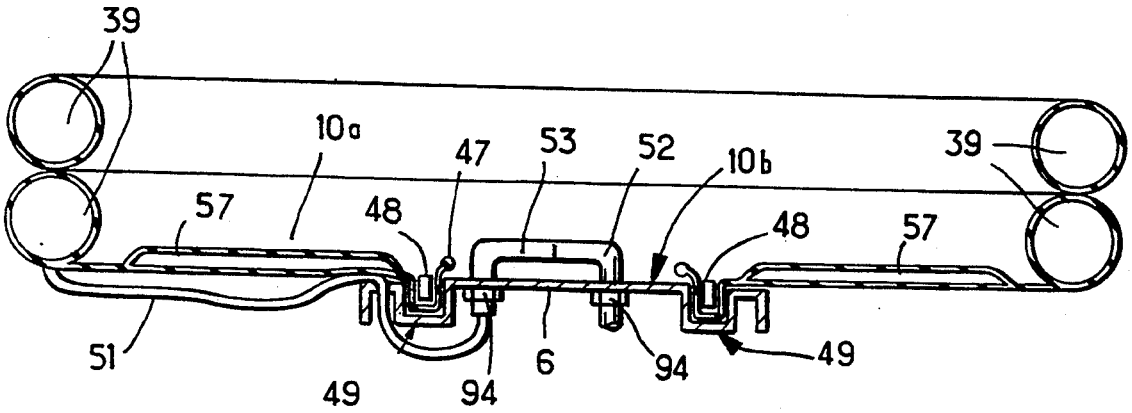
FIG. 6

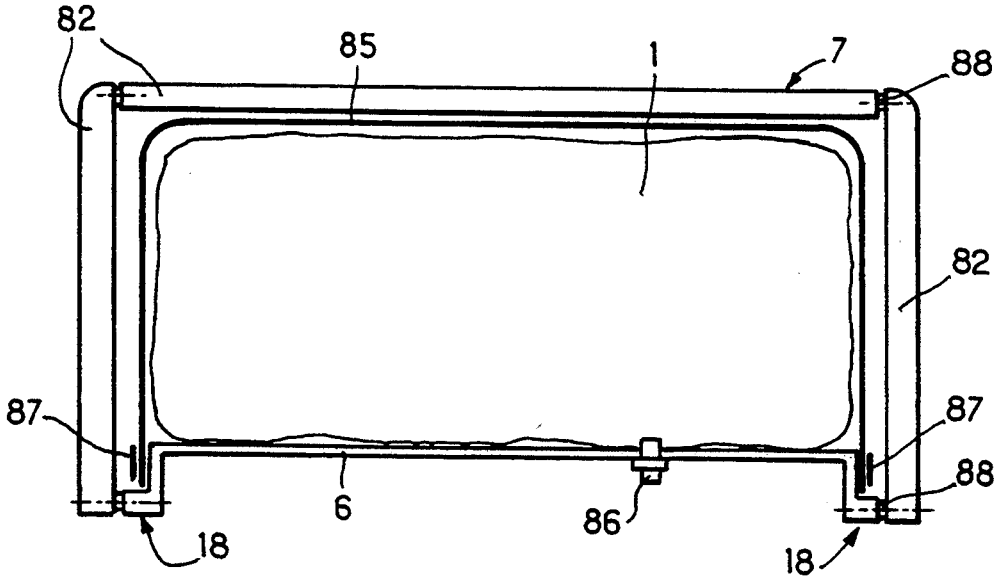
FIG. 10
FIG. 11
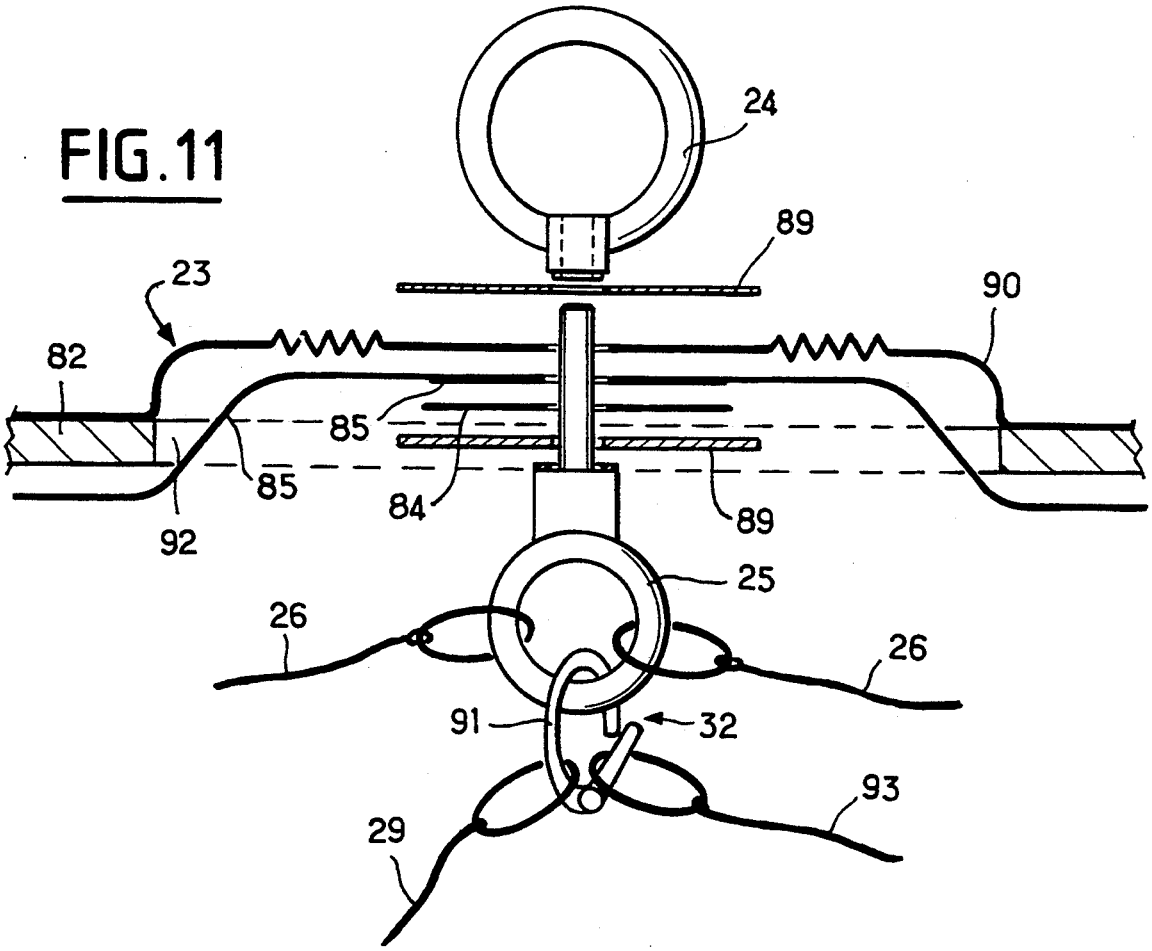

WATER SURVIVAL DEVICE

DESCRIPTION

The present invention relates to a water survival device of the inflatable liferaft type packed in a container.

It is known and often compulsory to place on board of ships of a certain tonnage inflatable liferafts that may be launched in the event of a shipwreck and which allow passengers to take refuge while awaiting rescue.

Currently known rafts have accommodation capacities ranging from several people to several tens of people. They are generally made up of a flexible floor which may be inflatable and which is equipped on its periphery with inflatable permanent fenders which provide buoyancy for the raft; the rafts are generally inflated after launch with the help of a pressurised gas supply composed, for example, of nitrogen which is generally mixed with carbon dioxide, and stored in a bottle generally attached to the inflatable permanent fenders.

These rafts are generally equipped with batteries providing a power supply for warning lights making spotting of the raft in the water easier.

The rafts also contain a waterproof supply of provisions and water to ensure temporary survival of the passengers.

The currently known rafts are packed in a substantially watertight manner (while deflated) in flexible cases or containers; containers are generally substantially cylindrical in shape and composed of two half-shells assembled with straps or other equivalent systems; devices exist that allow strap release, which in turn allows opening of the container and inflation of the raft, under the control of a manual device or of an automatic release mechanism—often called a hydrostatic release unit—which automatically triggers release and then opening of the container and inflation of the raft once the wrecked ship reaches a certain depth.

Currently known inflatable liferaft devices and the container thereof have many drawbacks; indeed, when the container opens, the two half-shells of which it is made are lost at sea; also, these containers are relatively heavy, often have defective seals, are not easy to handle and require cradle-shaped supports equipped with straps; in addition to this, the equipment composed of the pressurised gas bottles, the provisions and other accessories as well as the inflation triggering line—occasionally called manoeuvre line—are totally enclosed in the container: it is therefore necessary to open the container in order to check the equipment—this checkup is compulsory in many countries—and to completely unfold the raft.

Such openings which must often be performed annually, followed by renewed conditioning of the raft and of its equipment in the container, although generally performed by specialised companies employing qualified personnel, generate additional risks of deterioration of the seal of the raft and malfunction of certain components of the equipment as a result of these frequent manipulations. In addition to this, these inspections are expensive for the ship's owner or manager.

The aim of the present invention is to compensate for these faults, the aims are reached with the present invention by providing a water survival device of the liferaft type packed in a container, equipped with survival material comprising at least one pressurised gas bottle such that said container comprises at least a first waterproof compartment and a second waterproof compartment, with such waterproof compartments being separated by a watertight partition, said first waterproof compartment may contain said liferaft, said second waterproof compartment may contain said survival material, and such that said second waterproof compartment may be opened without opening said first waterproof compartment, so as to allow the inspection and control of said survival material contained in said second waterproof compartment without opening said first waterproof compartment.

Advantageously, a device according to the invention is such that said container comprises said watertight partition which is substantially planar in shape and includes a top lid and a bottom lid which may be fixed on either side of said watertight partition such that said watertight partition and said top lid define said first waterproof compartment, and such that said watertight partition and said bottom lid define said second waterproof compartment.

A device according to the invention may be such that said top lid comprises zones of lesser resistance, such that said lid is likely to open under the effect of the pressure applied by said liferaft as it is inflated.

Preferably, a device according to the invention is such that said watertight partition makes up at least part of the floor of said liferaft, and such that said watertight partition comprises at least one hatch, such that as said hatch is opened, access is provided, from the inside of said liferaft, to said second waterproof compartment, at least part of said survival material may be reached in this way while said liferaft is at sea.

A device according to the invention may comprise means allowing, without opening said waterproof compartment, control of the pressure prevailing in said waterproof compartment.

Advantageously, a device according to the invention is such that said watertight partition is crossed by at least one pipe for transporting said pressurised gas.

Furthermore, said top lid may comprise at least one impact-cushioning zone, such that, as said liferaft packed in said container is launched, it is protected against impacts.

Said container may furthermore include runner-shaped supports and stowage means for stowing said container to a ship, such that said container may be kept in place on an inclined plane of said ship, and such that as said stowage means of said container are deactivated, said container may slide down said inclined plane and be easily launched from said ship.

Advantageously, said watertight partition is fitted, on its periphery, with an edge to which at least one of said top or bottom lids may be attached.

Said watertight partition may be substantially rectangular in shape, preferably substantially square in shape, and such that the corners of said rectangle, preferably of said square, are rounded.

Said top lid may be composed of at least two rigid components assembled by linkage means, and of a flexible waterproof envelope of said liferaft, with said flexible envelope being situated between said rigid components and said liferaft and attached to said watertight partition.

In a device according to the invention, designed to be mounted under a davit, said top lid may comprise a zone of lower resistance, said zone being fitted, on its outer surface with a lifting ring and on its inner surface with an internal ring, these rings being attached to one another, and the device includes suspension lines of which a first extremity is attached to said internal ring and a second extremity to said liferaft, and it also comprises a detachable link of which a first extremity is attached in a detachable manner to said internal ring and a second extremity to said watertight partition, and it comprises means for detaching said detachable link during inflation of said liferaft.

The advantages provided by the invention are numerous; the inflatable part of the raft is contained totally, and in a waterproof manner, in the first waterproof compartment, whereby it does not require an annual inspection; an inspection every five years or more is quite conceivable.

The equipment, bottles and manoeuvre lines section, placed in the second waterproof compartment which may be dismantled without opening the first waterproof compartment, allows facilitated annual inspections (necessary because of perishable foodstuffs).

The device according to the invention ensures absolute and controllable protection of the inflatable part of the raft and allows easy access to perishable elements requiring frequent inspection, which may be carried out by non-specialist personnel.

The invention also provides a raft in a container whose weight is balanced allowing easy handling compared to other known rafts due to the low position of the heavier elements, and whose penetration into water is also improved, thanks, in particular, to the shockproof shield.

Launching is also made easy thanks to the runner-shaped supports which allow the container to be slid to the launch zone, whereas conventional containers must be removed from their cradles and carried to the launch zone.

These factors allow for a more rapid launch of the raft and further increase security.

All these advantages will be better understood through the following description, which refers to the appended drawings, of particular embodiments of the device according to the invention, which are in no way restrictive.

FIG. 3 is a lateral view of another raft embodiment and of its container according to the invention.

FIG. 4 is a partial view along IV—IV of FIG. 3.

FIG. 5 is a plan view of an inflated raft.

FIG. 6 is a view along VI—VI of FIG. 5.

FIGS. 9A, 9B, 9C, 9D and 9E schematically illustrate the folding operations of a raft according to the invention.

FIG. 10 is a cross-sectional view of a preferred embodiment of a device according to the invention.

FIG. 11 is a view of an embodiment of the hoist device for the container containing the raft.

Figure 1:
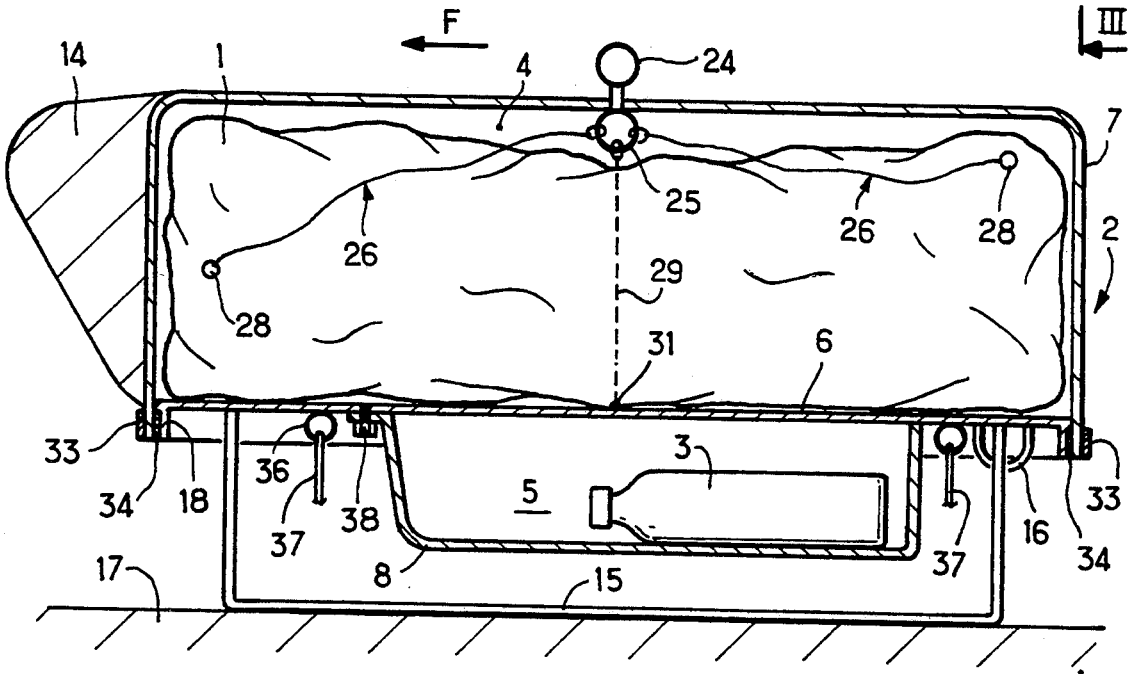
FIG. 1 is a lateral section view of a raft embodiment and of its container under a davit according to the invention.

In FIG. 1 it may be observed that the inflatable liferaft 1 is contained in a first waterproof compartment 4 of the container 2.

Said container 2 includes a second waterproof compartment 5 containing in particular at least one pressurised gas bottle 3 intended for use in the inflation of said raft, when launched.

Said first waterproof compartment is defined by a top lid 7 and a watertight partition 6. Said waterproof top lid is attached to the edge 18 of said watertight partition by means 33 such as a metal rim around said top lid. The link between said top lid and said edge of said watertight partition may be maintained watertight by means of a seal 34.

Said second waterproof compartment is defined by a bottom lid 8 and said watertight partition.

Said bottom lid is attached to said watertight partition by conventional linkage means such as screws 38; waterproofing means are provided between said bottom lid and said watertight partition in order to render said second compartment waterproof.

It may be seen that in the upper part of said container, in a zone of lesser resistance 23 of said top lid, a lifting ring 24 is provided to suspend said container from known means generally called davits. Said lifting ring 24 which is placed on the outside of said container is attached to an internal ring 25 situated in said first waterproof compartment.

Within said first waterproof compartment, suspension lines 26 are provided, of which a first extremity 28 is attached to said inflatable liferaft and of which the second extremity is attached to said internal ring.

A detachable link 29 may also be found in said first waterproof compartment, and said detachable link has a first extremity attached in a detachable manner to said internal ring and a second extremity 31 attached to said watertight partition, close to the center of gravity of said container.

Figure 2:
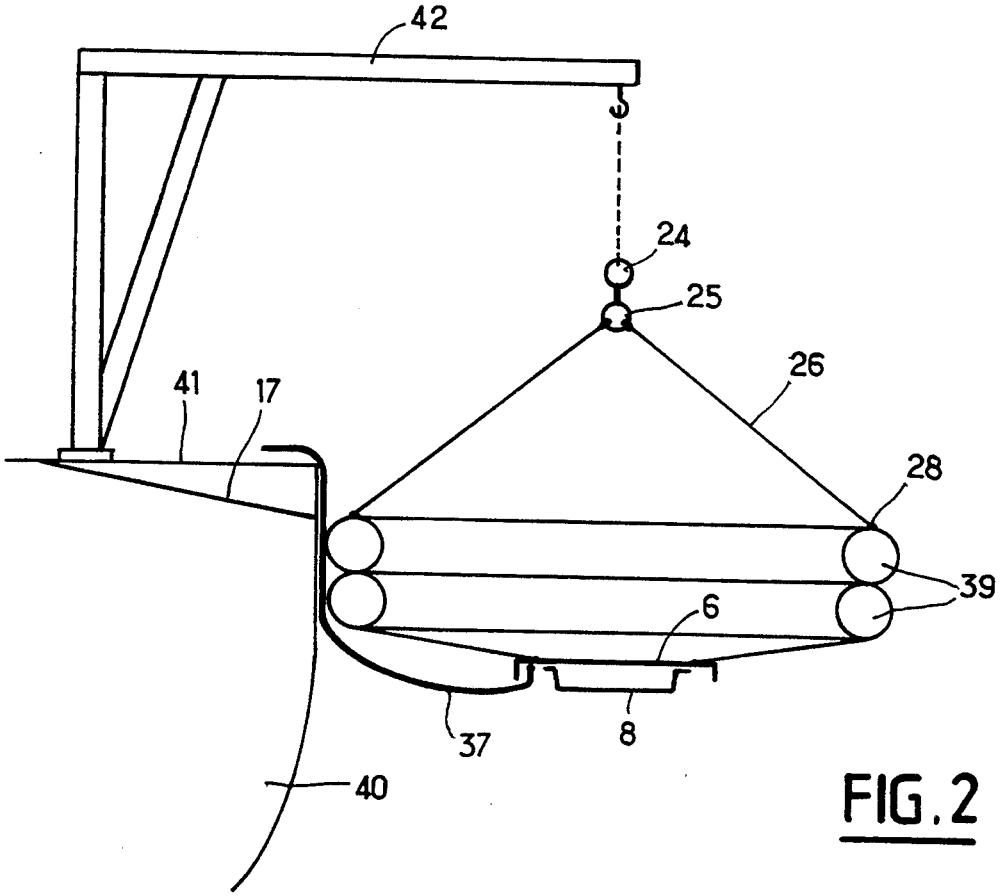
FIG. 2 shows the attachment of a raft under a davit according to the invention.

Said suspension lines are not taut between their extremities within said first waterproof compartment. The length of said detachable link 29, on the other hand, corresponds approximately to the distance separating said internal ring of said top lid from said watertight partition, and is therefore more or less taut between its two points of attachment. Therefore according to the invention, when said container is lifted by means of said lifting ring, the weight of said container containing said raft and survival equipment, is supported by said internal ring and said lifting ring as well as by said detachable link. Once said raft is in a position where it may be inflated the means releasing said pressurised gas contained in said bottle 3, towards the permanent fenders 39 of said raft are activated, as represented in FIG. 2. The force applied by the inflation of said permanent fenders against the walls of said top lid causes the bursting or tearing of said top lid; said permanent fenders may then be freely inflated thus giving said raft its shape, and moving away from the center of said watertight partition; by this movement, means for detaching said detachable link are activated, causing the separation of one extremity of said detachable link 29 from said internal ring; the weight of said raft and of said second waterproof compartment, defined by said watertight partition and said bottom lid, is then supported by said suspension lines 26 and said rings 24, 25, as shown in FIG. 2.

From FIG. 1 it may be seen that said top lid includes, on one of its lateral surfaces, a protuberant and deformable zone 14; said zone is intended to cushion impacts against said container during launching thereof.

Launching may be carried out by a translatory movement according to arrow F.

Said launch may be facilitated by mounting said container on an inclined plane 17 fitted to the deck 41 of a ship 40 as represented in FIG. 2.

Said container includes runner-shaped supports 15 and means of stowage 16 to said ship, such as a ring through which a rope may be threaded.

According to the invention, when said stowage means are deactivated, said container may slide down said inclined plane thus providing a facilitated launch.

In the lower part of said container, preferably under said watertight partition, compartments 36 are advantageously provided to house the links 37 for stowing the raft under the davits.

Said links 37 are useful, in the event of raft launching from under davits 42, to hold said raft against the side of said ship and to allow boarding of passengers as shown in FIG. 2. The materials chosen for construction of said container may be, for example, plastic for said top lid, a synthetic resin reinforced with glass fibers for said watertight partition and polyurethane for said deformable zone 14 of said top lid.

From FIG. 3, it may be seen that said runner-shaped supports 15 can advantageously slide on rails 35 which may, for example, be U-shaped in section and which may be attached to said inclined plane 17 of the deck of said ship. It may be observed that said container comprises said top lid 7 and said bottom lid 8, said lids being respectively attached to said edges of said watertight partition 6 and under said watertight partition.

Said container 2 may be equipped with means 12 for controlling the pressure prevailing inside said first waterproof compartment enclosing said liferaft; said means of pressure control may be, for example, made up of a manometer of the U-shaped tube type, or of any other known means. Indeed, according to the invention, during factory preparation of said liferaft and its container, said liferaft, in a deflated state, is enclosed in said first waterproof compartment sealed by said watertight partition and by said top lid. Are then connected, known means of air suction, such as a vacuum pump to said first waterproof compartment and any air emprisoned in said first waterproof compartment is removed.

Dry and inert gas can advantageously be introduced, such as nitrogen for example, into said first waterproof compartment, until the pressure prevailing in said first waterproof compartment reaches a predefined value; said value should be advantageously chosen outside the range of variation of atmospheric pressure, i.e. it should be set at a value which is greater than 105,000 pascals or smaller than 96,000 pascals. In this way, if the seal of said first waterproof compartment is correctly established, the pressure prevailing within said first waterproof compartment will remain close to that established in the factory, and it is possible to control in a permanent manner whether this pressure is indeed different from the atmospheric pressure, and hence determine whether the seal of said compartment is intact; alternately, other known seal-control systems may be used for said first waterproof compartment.

It may also be seen from FIG. 3 and from FIG. 4 that the device according to the invention is equipped with an external raft inflation triggering line 43, of which one extremity is attached by linkage means 46 to an interior line 44 for the triggering of inflation of said permanent fenders of said raft. It may be observed that, in a known manner, said linkage means 46 are equipped with a ring situated on the inside of said second waterproof compartment 5 and a ring situated on the outside of said second waterproof compartment, said rings being attached by a component placed in a thin area of said bottom lid 8; the second extremity of said external inflation triggering line 43 may be housed in a compartment 45, thus remaining easily accessible.

It may be seen from these figures, that said second waterproof compartment 5 is advantageously separated into two sections labelled **5*a* and 5*b*, separated by a partition 5*c***, which must be waterproof.

Said pressurised gas bottle and possible sea cells are advantageously placed in said section **5*a* of said second waterproof compartment, and survival provisions are placed in said section 5*b*** of said second waterproof compartment.

In FIG. 5, it may be seen that said watertight partition 6 makes up part of the floor 10 of said inflatable raft 1; it may be seen from FIGS. 5 and 6 that said inflatable liferaft is equipped with a flexible floor **10*a* of which one section 57** at least is inflatable.

According to the invention, said flexible floor **10*a* is advantageously equipped with inflatable 57 and non-inflatable 58 sections. Said non-inflatable sections extend substantially radially; it may be observed that the rigid section 10*b* of said floor composed of said watertight partition 6** is substantially central in position; said watertight partition is substantially square in shape and with rounded corners.

From FIGS. 5 and 6 it may be seen that the pressurised gas supply pipe 52 coming from said bottle (not shown) crosses said watertight partition and splits into two flow pipes 53 for starting said pressurised gas towards said permanent fenders.

Said flow pipes 53 advantageously cross said watertight partition, and are extended by flexible pipes 51 carrying said pressurised gas to said permanent fenders 39.

A pipe 56 of which one extremity communicates with said inflatable sections 57 of said floor, is advantageously equipped with, at its other end, a stop valve 55 and a joint 54, allowing the introduction of air so as to inflate said floor, for example with a manual pump.

Said pipes 52 and 53 are also equipped advantageously with a link joint 94.

It may be seen from FIG. 6 that in a preferred embodiment, said flexible floor **10*a* is fitted in its center with an opening corresponding substantially to the circumference of said watertight partition, and is equipped with a roll 47** at the edge of said opening.

According to the invention, said flexible floor **10*a* is fixed to said rigid floor 10*b* composed of said watertight partition 6 by means of a groove 49 provided in said watertight partition, on its periphery; said flexible floor may therefore be maintained by a clip frame 48 which is itself attached to said rigid floor by means of screws 50**, or any other known means.

It may be seen from FIG. 5 that said watertight partition is equipped with a hatch 11, which may be opened and therefore allow access to a section of said second waterproof compartment placed under said watertight partition making up said rigid floor.

In a preferred embodiment, said hatch is composed of a rigid section which may be dismantled in order to allow access to said second waterproof compartment; its waterproofness may for example be ensured by a thin film of approximately the same size as said hatch, which may be glued to said watertight partition, and which may be easily removed when said hatch is opened.

Due to the particular configuration of said inflatable and non-inflatable sections, and to the fact of the relative sinking into the water of said rigid floor compared to said permanent fender, due to the weight of the people in said raft and to the weight of said second waterproof compartment, drainage is therefore favoured, from the periphery towards the center of said floor as well as accumulation of the water capable of penetrating into said raft and evacuation of said water is made possible, for example, by means of a bailer or manual pump. In these figures an inflatable raft has been represented as substantially circular in shape, but the characteristics of the invention are of course applicable to inflatable liferafts of any shape.

Figure 7:
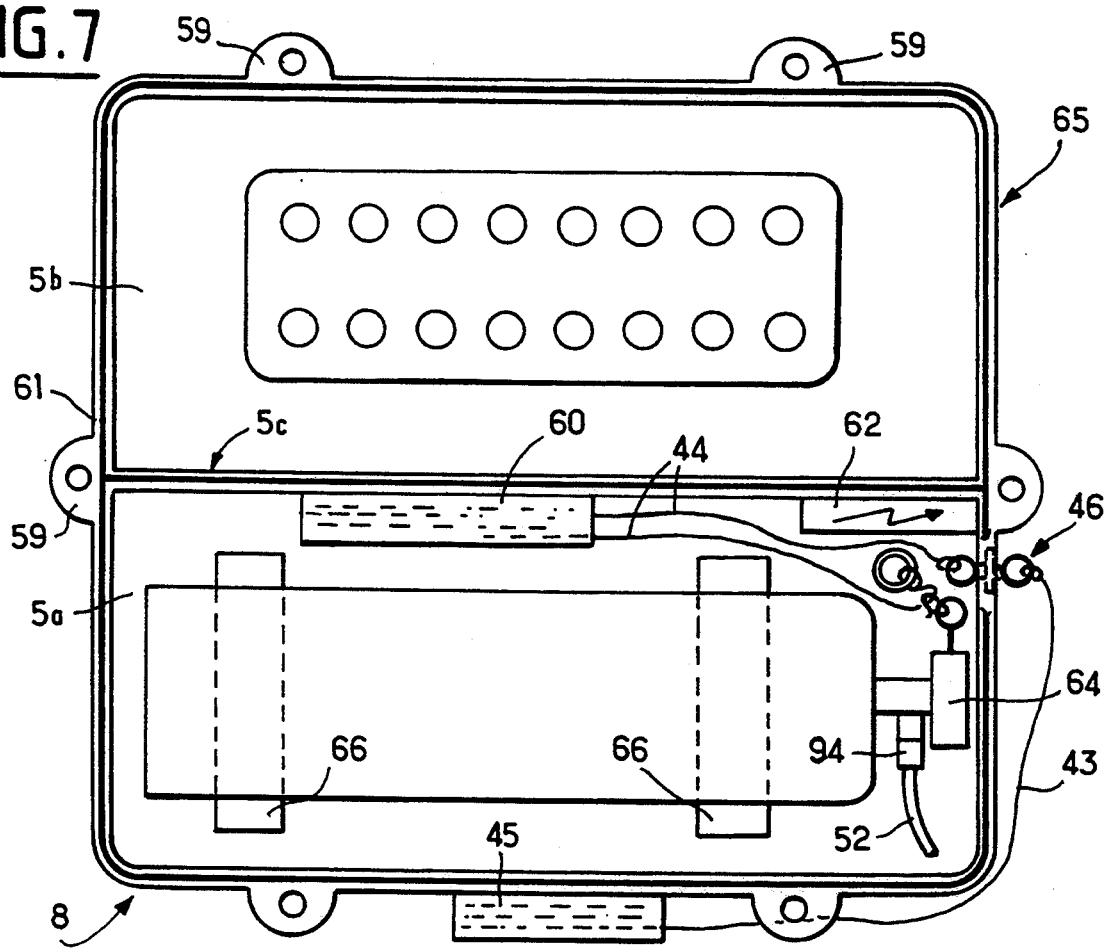
FIG. 7 is a plan view of a second waterproof compartment of a raft according to the invention.

From FIG. 7 one may observe that said bottom lid 8 is preferably rectangular or square in shape and is equipped with rounded corners. Said bottom lid may be fitted with fixation loops 59 provided with a hole to allow passage of means—such as screws—for fixation to said watertight partition.

Said lid is advantageously fitted with a partition 5*c* separating the two sections 5*a* and 5*b* of said second waterproof compartment 5. The lateral walls 65 along with said partition 5*c* are equipped in their upper section situated facing said watertight partition, and in contact with said watertight partition during assembly, with a seal 61 which ensures the waterproofness of the assembly.

It may be observed that in section 5*b* of said second waterproof compartment, the survival equipment 63 is provided, being composed in particular of provisions, water and a first-aid kit. In section 5*a* of the second waterproof compartment, said pressurised gas bottle 3 is fitted in a removable manner, for example on cradle-shaped supports 66; said bottle 3 is generally fitted at one of its extremities with an inflation triggering device 64 which, when activated, allows the exit of the gas contained in said bottle, into said exit pipe 52 (partially shown) by means for example of a joint 94.

In said section 5*a* of said second waterproof compartment, are to be found sea cells 62, along with a compartment 60 of the interior inflation triggering line 44, which will accommodate the necessary—and statutory—length of said line 44.

Said interior inflation triggering line 44 may advantageously be made up of two sections attached by a release clip (not shown), such that, after launching of said raft, said sections of said line 44 may be easily separated, one section remaining attached to said raft, the second section remaining attached to the craft from which said raft was launched.

It can also be seen from this figure that means 46 are provided to link said interior line 44 to said exterior inflation triggering line 43, and that a compartment 45 has been provided for said exterior inflation triggering line on one of said lateral walls of said bottom lid, on the outside thereof.

A device for the control of the pressure prevailing within said bottle 3, may advantageously be placed in said section 5*a* of said second waterproof compartment, such as a manometer for example; in this case, it is useful to fit into one of the lateral walls 65 a waterproof translucent window, placed facing said manometer, such that said pressure in said bottle may be easily controlled from the outside, without requiring any intervention on said raft or its container.

Figure 8:
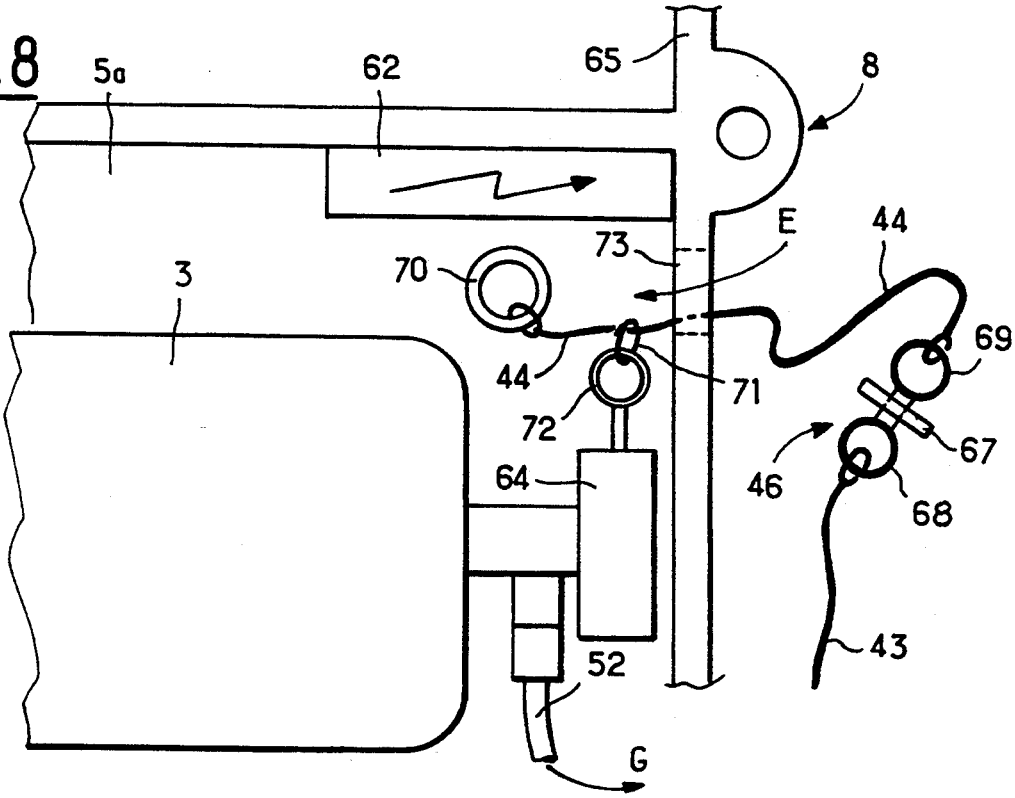
FIG. 8 is a different scale view of a detail of FIG. 7.

From FIG. 8 it may be seen that to trigger inflation of said liferaft, a traction is operated on the free end of said external inflation triggering line 43; once said external line 43 is taut, said traction is applied to said linkage means 46 made up of an external ring 68 rigidly linked to an internal ring 69, said rings are placed on either side of a thin element 67 of said lateral wall 65 of said bottom lid 8, such a thin element 67 will come away from said wall 65 under the effect of said traction—by ripping—thus creating an opening 73 in said wall 65.

Said internal inflation triggering line 44, of which one extremity is tied to said internal ring 69 will then unroll under the effect of said traction transmitted by said linkage means 46.

It may be observed that the second extremity of said internal line 44 is fixed to a stowage ring 70, solidly attached to said bottom lid of said raft and that said internal line 44 passes through a shackle 71 attached to the triggering handle 72 of said inflation triggering device 64 placed on said bottle 3, contained in said section 5*a* of said second waterproof compartment.

Due to said traction, said internal line 44 will activate said inflation triggering device 64 which will in turn allow said pressurised gas to escape from said bottle, through said exit pipe 52, as showed by arrow G.

Simultaneous to the apparition of said opening 73 due to said ripping of said thin element 67, sea water will penetrate following arrow E into said section 5*a* of said second waterproof compartment and may therefore activate said sea cells 62.

Figure 9A:
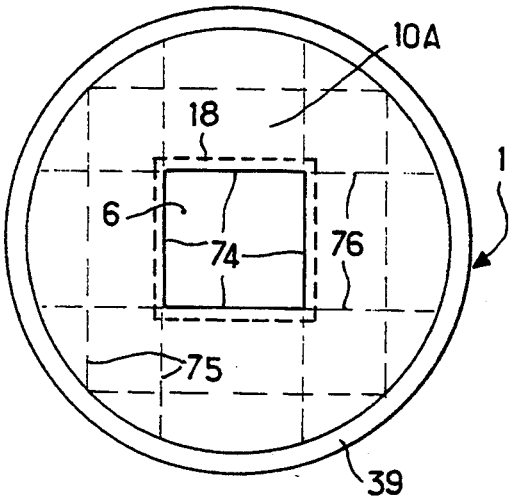
Figure 9B:
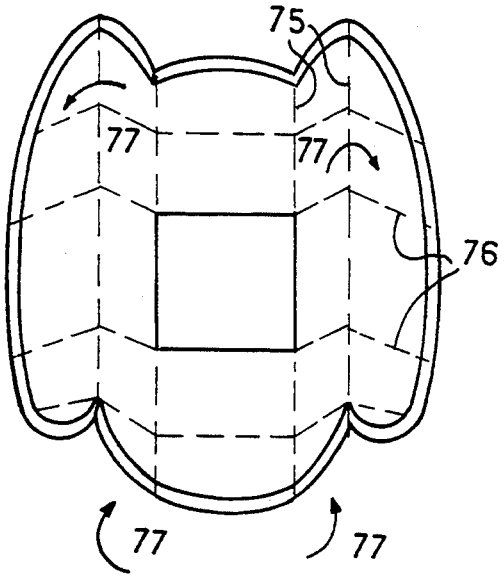

FIGS. 9*a* and 9*b* show the principal steps of the folding procedure of said raft, allowing, when deflated, to place it on its support made up of said watertight partition, then to cover it with said top lid.

FIG. 9*a* shows said inflatable raft 1, in its deflated state, comprising said permanent fenders 39, substantially circular and said flexible floor 10*a*, fitted in its center with said opening defined by the edges 74 made up of said rolls—reference 47 of FIG. 6—which are substantially parallel to said edges 18 of said watertight partition 6.

Folding is carried out along so-called vertical (referring to the orientation of the drawing on the sheet) folding lines 75 and so-called horizontal folding lines 76, said lines being substantially parallel to said edge 18 of said watertight partition 6.

In FIG. 9*a*, said raft is ready to be folded.

Figure 9C:
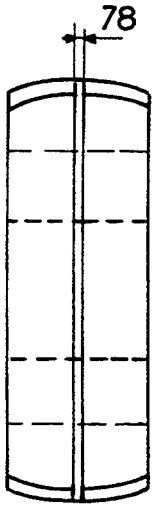

In FIG. 9*b*, it may be observed that folding takes place along said vertical lines 75, as shown by arrows 77 so as to leave a vertical space 78 of a few centimeters, once this first folding has been accomplished, as shown in FIG. 9*c*.

Figure 9D:
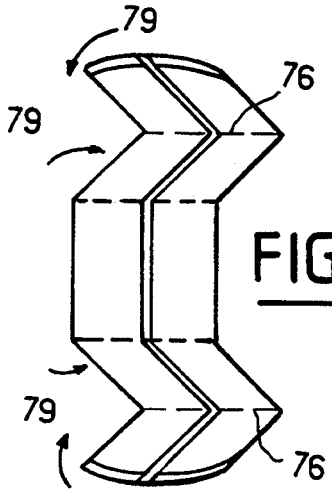
Figure 9E:
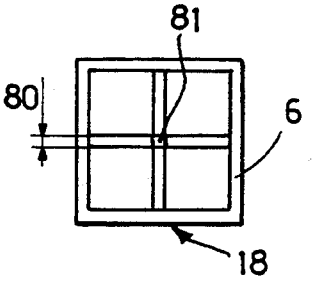

FIG. 9*d* shows that folding is then carried out along said horizontal lines 76, as shown by arrows 79, so as to leave a horizontal space 80 of approximately the same size as said vertical space, as shown in FIG. 9*e*.

It may be observed in this figure that, subsequent to folding of said deflated raft, the latter is placed inside the surface of said watertight partition 6, defined by edges 18.

Advantageously, thanks to said horizontal and vertical spaces, a well-shaped space 81 is thus created in the center of said inflatable raft folded on said watertight partition, such that, through said well-shaped space, the detachable link may be passed—reference 29 of FIG. 1—and one extremity of said detachable link—reference 31 of FIG. 1—may be attached to said watertight partition 6.

FIG. 10 represents a preferred embodiment according to the invention. Said top lid 7 is made up of several panels 82 which are joined together with waterproof linkage means 88.

Said panels ensure mechanical protection of said raft 1; they may be, for example, made up of a "sandwich" comprising two rigid external skins which may be of metallic or plastic nature, between which a foam, for example polyurethane, is injected.

In order to perfect the waterproofness of said first waterproof compartment defined by said top lid 7 and said watertight partition 6, on top of said waterproof linkage means 88, a flexible envelope 85 is provided which surrounds said raft 1 and which may be circled round said edges 18 of said watertight partition 6; it is therefore possible, prior to assembly of said panels making up said top lid, after the installation of said flexible envelope, to establish a relative vacuum within the chamber made up of said flexible envelope and said watertight partition, thanks to an opening equipped with a valve 86 in said watertight partition, and thus to ensure the waterproofness of said chamber.

When said top lid is assembled onto said watertight partition 6, thus constituting said first waterproof compartment, said inert, preferably dry, gas may also be injected into said chamber through the above-mentioned valve.

FIG. 11 represents an exploded view of a device according to the invention equipped with said top lid made up of said panels 82, and equipped with said flexible envelope 85, for use with rafts under davits as shown in FIG. 1.

The lifting means of said raft and of its container comprise said lifting ring 24 attached to said internal ring 25, said ring receiving in turn the extremity of said suspension lines 26 and one extremity of said detachable link 29, via said detachment means 32; it may be observed that said detachment means may be composed of a shackle 91 which may open under the effect of the traction applied by the traction link 93, of which one extremity is attached to said inflatable raft.

Alternately, said detachment means may be fitted with a guillotine capable of cutting said detachable link, such a guillotine would be activated by said traction link.

It may be seen that a window 92 is advantageously provided in said panel 82 located on the upper part of said top lid, along with a gusset 90 attached to said panel 82 close to the edges of said window, such a gusset constitutes one of said lower resistance zones 23.

It may be observed that between said rings 24, 25 likely to be attached together by use of male and female threads with which they are respectively equipped, are provided, from bottom to top, a first seal 84, a first washer 89 which may be metallic, a second seal 84, said flexible envelope and said gusset each fitted with a hole to allow passage of said male thread, and a second washer 89.

The technical field of the invention is that of inflatable liferaft construction.

I claim:

1. Water survival device of the inflatable liferaft type packed in a container and equipped with survival material comprising one pressurised gas bottle, said water survival device comprising:

a planar rigid watertight partition, a top lid fixed on a peripheral edge of said watertight partition and defining with said watertight partition a first waterproof compartment containing said liferaft, a bottom lid fixed under said watertight partition, and defining with said watertight partition a second waterproof compartment containing said survival material, so that said second waterproof compartment can be dismantled without opening said first waterproof compartment, and wherein said liferaft when inflated comprises a floor comprising a flexible section and a rigid central section, said rigid central section of said floor being constituted by said watertight partition.

2. Device according to claim 1 wherein said top lid comprises at least one impact-cushioning zone such that, as said liferaft packed in said container is launched, it is protected against impacts.

3. Device according to claim 1 wherein said top lid comprises zones of lesser resistance, such that said top lid is prone to open under the effect of a pressure applied by said liferaft when said liferaft is inflated.

4. Device according to claim 1 wherein said first waterproof compartment is factory-filled with an inert gas, at a pressure which is substantially different from atmospheric pressure and wherein it comprises means allowing, without opening said first waterproof compartment, control of a pressure prevailing within said first waterproof compartment.

5. Device according to claim 1 wherein said watertight partition is crossed by at least one pipe for transporting said pressurised gas.

6. Device according to claim 1 wherein said container is furthermore equipped with runner-shapped supports and stowage means for stowing said container to a ship, such that said container may be kept in place on an inclined plane of said ship, and such that as said stowage means of said container are deactivated, said container may slide down said inclined plane and be easily launched from said ship.

7. Device according to claim 1 wherein said watertight partition is substantially in shape of a rectangle or of a square.

8. Device according to claim 1 wherein said top lid is composed of at least two rigid components assembled by linkage means, and of a flexible waterproof envelope of said liferaft, said flexible envelope being situated between said rigid components and said liferaft and being attached to said watertight partition.

9. Device according to claim 1 designed to be mounted under a davit, wherein said top lid comprises one zone of lower resistance, said zone being fitted on its outer surface with a lifting ring and on its inner surface with an internal ring, said rings being attached to one another, and wherein it includes suspension lines of which a first extremity is attached to said internal ring, and a second extremity is attached to said liferaft, and wherein it includes a detachable link of which a first extremity is attached in a detachable manner to said internal ring and a second extremity is attached to said watertight partition, and wherein it comprises means for detaching said detachable link during inflation of said raft.

10. Water survival device of the inflatable liferaft type packed in a container equipped with survival material comprising one pressurized gas bottle, wherein said container comprises a first waterproof compartment containing said liferaft, and said container comprises a second waterproof compartment containing said survival material, said first and second waterproof compartments being separated by a rigid watertight partition which is substantially planar in shape, said water survival device comprising means for opening said second waterproof compartment without opening said first waterproof compartment, so that it is possible to inspect and control said survival material contained in said second waterproof compartment without opening said first waterproof compartment, wherein said first waterproof compartment is factory-filled with an inert gas, at a pressure which is substantially different from atmospheric pressure and wherein it comprises means allowing, without opening said first waterproof compartment, control of a pressure prevailing within said first waterproof compartment.

11. Device according to claim 10 wherein said watertight partition makes up at least part of a floor of said liferaft, and said watertight partition comprises at least one hatch, such that, when said hatch is opened, access is provided from the inside of said liferaft to said second waterproof compartment, whereby at least part of said survival material may be reached in this way while said liferaft is at sea.

12. Device according to claim 10 wherein said container is furthermore equipped with runner-shapped supports and stowage means for stowing said container to a ship, such that said container may be kept in place on an inclined plane of said ship, and such that as said stowage means of said container are deactivated, said container may slide down said inclined plane and be easily launched from said ship.

13. Water survival device of the inflatable liferaft type packed in a container and equipped with survival material comprising one pressurized gas bottle, said water survival device comprising:

a planar rigid watertight partition, a top lid fixed on one side of said watertight partition and defining with said watertight partition a first waterproof compartment containing said liferaft, a bottom lid fixed on another side of said watertight partition, and defining with said watertight partition a second waterproof compartment containing said survival material, so that said second waterproof compartment can be dismantled without opening said first waterproof compartment, wherein said first waterproof compartment is factory-filled with an inert gas, at a pressure which is substantially different from atmospheric pressure and wherein it comprises means allowing, without opening said first waterproof compartment, control of a pressure prevailing within said first waterproof compartment.

14. Device according to claim 13 wherein said watertight partition makes up at least part of a floor of said liferaft, and said watertight partition comprises at least one hatch, such that, when said hatch is opened, access is provided from the inside of said liferaft to said second waterproof compartment, whereby at least part of said survival material may be reached in this way while said liferaft is at sea.

15. Device according to claim 13 wherein said container is furthermore equipped with runner-shapped supports and stowage means for stowing said container to a ship, such that said container may be kept in place on an inclined plane of said ship, and such that as said stowage means of said container are deactivated, said container may slide down said inclined plane and be easily launched from said ship.

16. Device according to claim 13 wherein said top lid is composed of at least two rigid components assembled by linkage means, and of flexible waterproof envelope of said liferaft, said flexible envelope being situated between said rigid components and said liferaft and being attached to said watertight partition.

* * * * *